US008529300B2

(12) United States Patent
Ritter et al.

(10) Patent No.: US 8,529,300 B2
(45) Date of Patent: Sep. 10, 2013

(54) ELECTRICAL CONNECTOR ASSEMBLY

(75) Inventors: Christopher David Ritter, Hummelstown, PA (US); Ronald A. Carns, Carlisle, PA (US); David K. Fowler, Boiling Springs, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 22 days.

(21) Appl. No.: 13/236,282

(22) Filed: Sep. 19, 2011

(65) Prior Publication Data

US 2013/0072071 A1 Mar. 21, 2013

(51) Int. Cl.
*H01R 13/502* (2006.01)

(52) U.S. Cl.
USPC ..... 439/701

(58) Field of Classification Search
USPC ..... 439/607.07, 607.05, 607.06, 701
See application file for complete search history.

(56) References Cited

U.S. PATENT DOCUMENTS

| | | | | |
|---|---|---|---|---|
| 6,743,057 | B2 | 6/2004 | Davis et al. | |
| 6,863,543 | B2 * | 3/2005 | Lang et al. | 439/75 |
| 7,682,193 | B2 | 3/2010 | Stoner | |
| 7,871,296 | B2 | 1/2011 | Fowler et al. | |
| 8,011,957 | B2 * | 9/2011 | Pan | 439/607.05 |
| 2010/0221959 | A1 * | 9/2010 | Pan | 439/701 |

* cited by examiner

*Primary Examiner* — Phuong Dinh

(57) ABSTRACT

An electrical connector assembly includes a front housing that has a mating interface. Contact modules are loaded into the front housing and extend rearward from the front housing. Each contact module has a plurality of conductors that are held by a dielectric contact module body. The conductors have mating portions that extend from the contact module body and mounting portions that extend from the contact module body. The contact modules have channels formed therein. An organizer bar is received in the channels of the contact modules. The organizer bar is manufactured from a dielectric material. The organizer bar holds the positions of the contact modules relative to one another.

20 Claims, 3 Drawing Sheets

ELECTRICAL CONNECTOR ASSEMBLY

BACKGROUND OF THE INVENTION

The subject matter herein relates generally to electrical connectors having contact modules.

Known electrical systems that utilize right angle electrical connectors typically include a plurality of contact modules or wafers that are held together in a common housing. The contact modules have conductors that extend between a mating interface and a mounting interface that are oriented perpendicular to one another. The mounting interface has a plurality of pins that are configured to be mounted to the circuit board. Such electrical connectors are not without disadvantages. For instance, due to manufacturing tolerances, contact preload at the mating interface or other factors, the contact modules may be improperly positioned or oriented for mounting to the circuit board. For example, the contact modules may be skewed or angled with respect to one another and/or the housing holding the contact modules, causing the pins to be misaligned with the corresponding vias in the circuit board. Mounting the electrical connectors to the circuit board in such case could damage the pins.

To address such misalignment problems, some known systems use stiffeners or clips to couple the contact modules together. The stiffeners are typically metal plates that extend along the outside of the contact modules and engage portions of the contact modules to hold the contact modules at predetermined positions with respect to one another. The stiffeners add to the overall size of the electrical connectors. The stiffeners also affect the electrical performance of the electrical connectors by acting as an antenna.

A need remains for an improved device for organizing and holding contact modules of electrical connectors.

BRIEF DESCRIPTION OF THE INVENTION

In one embodiment, an electrical connector assembly is provided having a front housing that has a mating interface. Contact modules are loaded into the front housing and extend rearward from the front housing. Each contact module has a plurality of conductors that are held by a dielectric contact module body. The conductors have mating portions that extend from the contact module body and mounting portions that extend from the contact module body. The contact modules have channels formed therein. An organizer bar is received in the channels of the contact modules. The organizer bar is manufactured from a dielectric material. The organizer bar holds the positions of the contact modules relative to one another.

Optionally, the organizer bar may engage all of the contact modules held by the front housing. The channels may be open sided and the organizer bar may be snapped into the channels through the open sides thereof. The organizer bar may be circular in cross-section. Optionally, the organizer bar may include an outer surface that is stepped and includes a plurality of shoulders. The channels may include shoulders, where the shoulders of the organizer bar engage corresponding shoulders of the channels to maintain the relative positions of the contacts modules with respect to the organizer bar.

Optionally, each contact module body may include a top, bottom, front, rear and opposite sides. The mating portions may extend from the front and the mounting portions may extend from the bottom. The contact modules may be held in the front housing such that the sides of adjacent contact modules face one another. The channels may be located at the intersection of the tops and rears of the contact module body.

The channels may be located at the intersections of the tops and the rears of the contact module bodies. The organizer bar may be received in the channels such that an outer surface of the organizer bar is positioned below the top and forward of the rear. The contact module body may include an outer perimeter defined by the front, top, rear and bottom, where the organizer bar is contained entirely within the outer perimeter of the contact module body. The channels may be located at the intersection of the tops and the rears of the contact module bodies, with each channel being bounded by an upper wall and a rear wall. An opening may extend between the upper wall and the rear wall and the organizer bar may be received in the channels through the openings between the upper walls and the rear walls. The openings may be narrower than a diameter of the organizer bar such that the organizer bar is retained within the channels by the upper walls and the rear walls.

Optionally, the organizer bar may be manufactured from a material having a dielectric constant approximately equal to a dielectric constant of the contact module body. The channels may be defined by interior surfaces of the contact module bodies that are stepped and include one or more flanges extending outward from the interior surfaces into the channels. The organizer bar may include grooves extending circumferentially around the organizer bar, where the flanges are received in corresponding grooves. The contact modules may be overmolded lead frames with the channels being formed during the molding of the contact module body in an area of the contact module body devoid of the conductors.

In another embodiment, an electrical connector assembly is provided having a front housing that has a mating interface. Contact modules are loaded into the front housing and extend rearward from the front housing. Each contact module has a plurality of conductors held by a dielectric contact module body. The contact module body has a top, a bottom, a front, a rear and opposite sides. The contact module body has a channel that extends therethrough between the sides. The channel is located at the intersection of the top and the rear of the contact module body. The conductors have mating portions that extend from the front of contact module body and mounting portions that extend from the bottom of the contact module body. An organizer bar is received in the channels of the contact modules. The organizer bar holds the positions of the contact modules relative to one another.

DETAILED DESCRIPTION OF THE INVENTION

Figure 1:
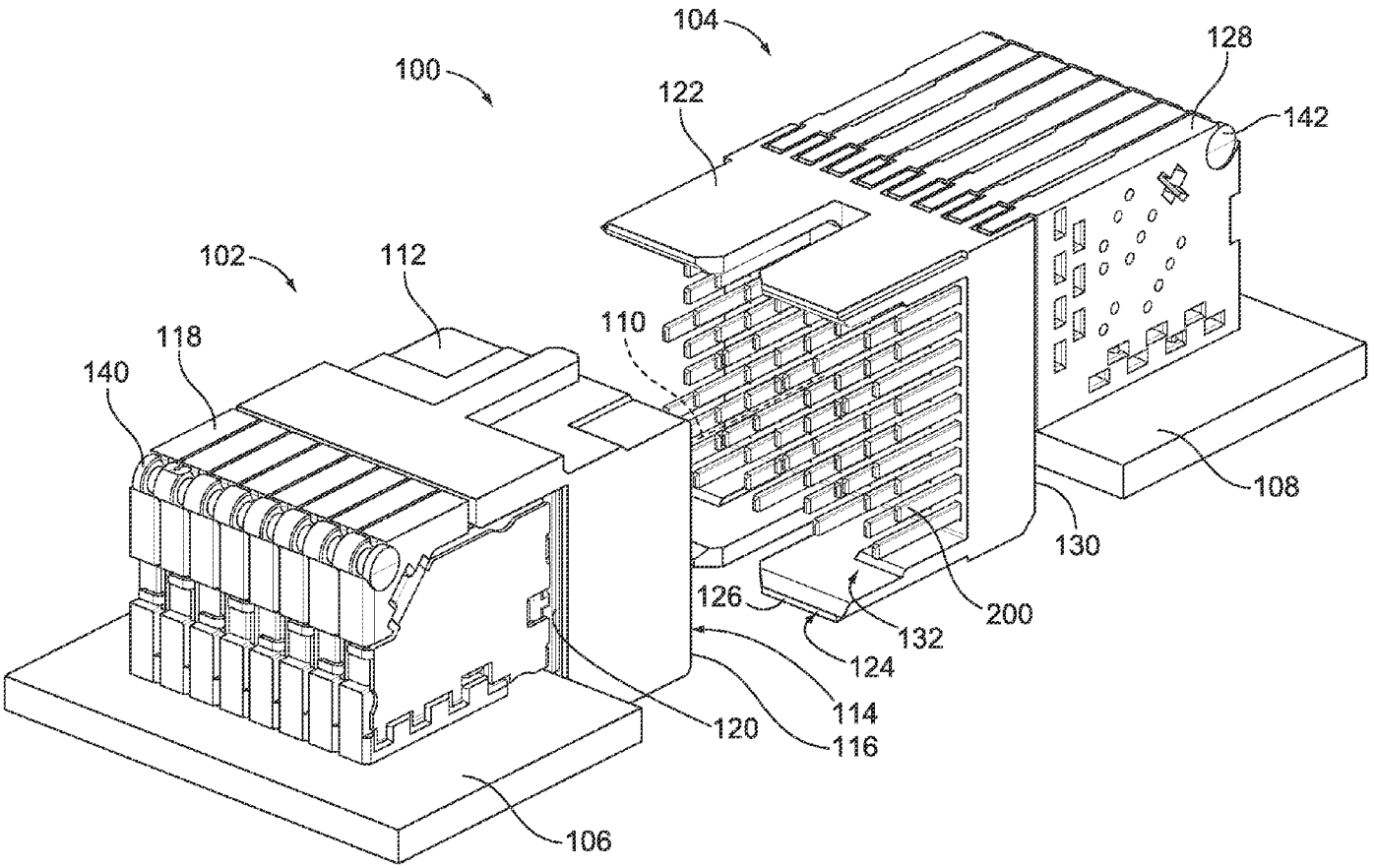
FIG. 1 is a perspective view of a coplanar connector system formed in accordance with an exemplary embodiment illustrating two connector assemblies that may be directly connected to one another.

FIG. 1 is a perspective view of an electrical connector system 100 formed in accordance with an exemplary embodiment illustrating two connector assemblies 102, 104 that may be directly connected to one another. The connector assemblies 102, 104 are each directly connected to first and second circuit boards 106, 108, respectively.

The connector assemblies 102, 104 are utilized to electrically connect the first and second circuit boards 106, 108 to one another. The connector system 100 electrically connects the first and second circuit boards 106, 108 without the use of header connectors mounted to a midplane circuit board. Alternatively, the connector system 100 may use header connectors mounted to a midplane circuit board with connector assemblies configured to mate to the header assemblies. Only one separable mating interface is provided between the first and second circuit boards 106, 108, namely the separable mating interface between the first and second connector assemblies 102, 104. Other configurations are possible in alternative embodiments, including a connector system that utilizes connector assemblies that mate to midplane connectors on a midplane circuit board.

The first and second circuit boards 106, 108 are co-planar or parallel to one another. Other configurations of the circuit boards 106, 108 are possible in alternative embodiments. A mating axis 110 extends through both the first and second connector assemblies 102, 104 and the first and second connector assemblies 102, 104 are mated with one another in a direction parallel to and along the mating axis 110. In an exemplary embodiment, both the first and second circuit boards 106, 108 extend generally parallel to the mating axis 110. In the illustrated embodiment, the connector system 100 electrically connects the first and second circuit boards 106, 108 without the use of a circuit board oriented perpendicular to the mating axis 110 arranged between the first and second connector assemblies 102, 104.

In the illustrated embodiment, the first connector assembly 102 constitutes a receptacle assembly, and may be referred to hereinafter as receptacle assembly 102. The second connector assembly 104 constitutes a header assembly, and may be referred to hereinafter as header assembly 104. The receptacle assembly 102 is configured for mating with the header assembly 104.

It is realized that in alternative embodiments the receptacle assembly 102 and header assembly 104 may be interchanged such that the receptacle assembly 102 may be mounted to the second circuit board 108 and header assembly 104 may be mounted to the first circuit board 106. It is also realized that different types of electrical connectors may be utilized to electrically connect the first and second circuit boards 106, 108 without the use of a midplane circuit board with corresponding header connectors mounted thereto. The different types of electrical connectors may have different shapes, form factors, mating interfaces, contact arrangements, contact types and the like in alternative embodiments. The receptacle assembly 102 and header assembly 104 are merely illustrative of an exemplary embodiment of the connector system 100.

The receptacle assembly 102 includes a front housing 112 having a mating interface 114 at a front 116 of the front housing 112. A plurality of contact modules 118 are held by the front housing 112. The contact modules 118 are loaded through and extend rearward from a rear 120 of the front housing 112. The contact modules 118 are electrically connected to the first circuit board 106. The mating interface 114 is oriented perpendicular with respect to the first circuit board 106 and the mating axis 110.

The header assembly 104 includes a front housing 122 having a mating interface 124 at a front 126 of the front housing 122. A plurality of contact modules 128 are held by the front housing 122. The contact modules 128 are loaded through and extend rearward from a rear 130 of the front housing 122. The contact modules 128 are electrically connected to the second circuit board 108. The mating interface 124 is oriented perpendicular with respect to the second circuit board 108 and the mating axis 110.

The front housing 122 includes a chamber 132 that receives at least a portion of the receptacle assembly 102. An array of contacts 200 are arranged within the chamber 132 for mating with corresponding mating contacts (not shown) of the receptacle assembly 102. The mating contacts 200 extend from corresponding contact modules 128 into the chamber 132 when the contact modules 128 are coupled to the front housing 122. The mating contacts 200 are electrically connected to the second circuit board 108 by the contact modules 128. In an alternative embodiment, the front housing 112 of the receptacle assembly 102 includes a chamber that receives at least a portion of the header assembly 104 therein.

The receptacle assembly 102 includes an organizer bar 140 coupled to the contact modules 118. In the illustrated embodiment, the organizer bar 140 engages all of the contact modules 118, however the organizer bar 140 may engage less than all of the contact modules 118 and/or more than one organizer 140 may be used to engage all of the contact modules 118 in alternative embodiments. The organizer bar 140 holds the relative positions of the contact modules 118 with respect to one another and/or with respect to the front housing 112. The organizer bar 140 holds the contact modules 118 at a predetermined pitch and/or spacing. The organizer bar 140 holds the contact modules 118 parallel to one another. The organizer bar 140 holds the conductors of the contact modules 118 at predetermined positions, such as at the mounting interface of the receptacle assembly 102, for mounting to the circuit board 106.

The header assembly 104 includes an organizer bar 142 coupled to the contact modules 128. In the illustrated embodiment, the organizer bar 142 engages all of the contact modules 128, however the organizer bar 142 may engage less than all of the contact modules 128 and/or more than one organizer 142 may be used to engage all of the contact modules 128 in alternative embodiments. The organizer bar 142 holds the relative positions of the contact modules 128 with respect to one another and/or with respect to the front housing 122. The organizer bar 142 holds the contact modules 128 at a predetermined pitch and/or spacing. The organizer bar 142 holds the contact modules 128 parallel to one another. The organizer bar 142 holds the conductors of the contact modules 128 at predetermined positions, such as at the mounting interface of the header assembly 104, for mounting to the circuit board 108. Optionally, the organizer bar 142 may be substantially similar to, or identical to, the organizer bar 140. The organizer bars 140, 142 may be coupled to the corresponding contact modules 118, 128, respectively, in similar manners.

Figure 2:
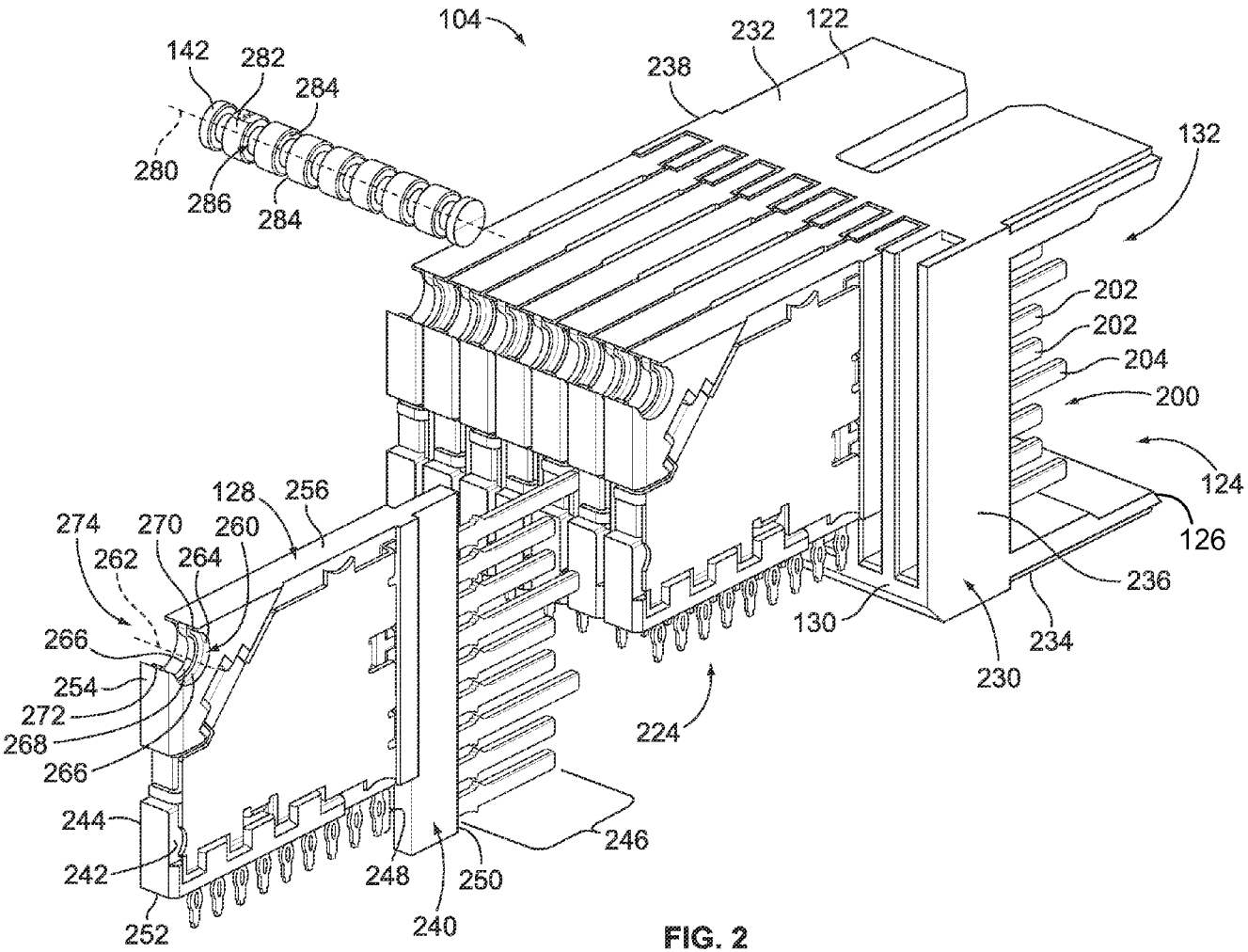
FIG. 2 is an exploded rear perspective view of the header assembly showing one of the contact modules poised for loading into the front housing

FIG. 2 is an exploded, rear perspective view of the header assembly 104, showing one of the contact modules 128 poised for loading into the front housing 122. The contact modules 128 include the contacts 200 and both the contact modules 128 and the contacts 200 are loaded through the rear 130 of the front housing 122. Optionally, the contacts 200, at the mating interface, may be blade-type contacts having a generally rectangular cross-section, however other contact types are possible in alternative embodiments. The contacts 200 are configured to be electrically connected to the circuit board 108 (shown in FIG. 1). The contacts 200 include a subset of signal contacts 202 and a subset of ground contacts 204. In an exemplary embodiment, the ground contacts 204 are longer than the signal contacts 202 such that the ground contacts 204 engage the contacts of the receptacle assembly 102 (shown in FIG. 1) prior to the signal contacts 202 engaging the contacts of the receptacle assembly 102. A sequential mating interface is defined by such arrangement. Optionally, the header assembly 104 may include other types of contacts, such as power contacts (not shown). The power contacts may have a length that is different from the ground contacts 204 and/or the signal contacts 202. Additionally, the header assembly 104 may have signal contacts 202 of different lengths.

The contact modules 128 define a mounting face 224 of the header assembly 104. The mounting face 224 is configured to be mounted to the circuit board 108 (shown in FIG. 1). The mating interface 124 is oriented perpendicular with respect to the mounting face 224, however non-perpendicular configurations are possible in alternative embodiments.

The housing 122 includes a body 230 extending between the front 126 at the mating interface 124 and the rear 130. The contact modules 128 are coupled to the rear 130 of the housing 122 and extend rearward from the rear 130. Optionally, at least a portion of the contact modules 128 may be loaded into the rear 130 and secured thereto.

The body 230 includes a top 232 and a bottom 234. The body 230 includes opposed sides 236, 238 that extend between the top 232 and the bottom 234. The chamber 132 is defined between the top 232 and the bottom 234.

In the illustrated embodiment, the contact module 128 includes a contact module body 240 having opposed sides 242, 244. The contact module body 240 holds the contacts 200. The contacts 200 include mating portions 246 that extend forward from the contact module body 240 and contact tails 248 that extend downward from the contact module body 240. Transition portions of the contacts 200 between the mating portions 246 and the contact tails 248 are encased by the contact module body 240. Optionally, the contact module body 240 may be overmolded over the contacts 200 with the mating portions 246 and the contact tails 248 extending from the contact module body 240. Optionally, the contacts 200 may be formed from a lead frame and the contact module body 240 may be overmolded around the lead frame. Alternatively, individual signal contacts, such as stamped and formed contacts, may be separately positioned within the contact module body 240.

The contact module body 240 includes a front 250, a bottom 252 that is perpendicular to the front 250, a rear 254 opposite the front 250 and a top 256 opposite the bottom 252. The front 250 defines a mating edge of the contact module 128 that is loaded into and mated to the front housing 122. The bottom 252 defines a mounting edge that is configured to be mounted to the circuit board 108. The contacts 200 generally extend between the mating edge and the mounting edge along a conductor plane. The mating portions 246 extend from the front 250. The contact tails 248 extend from the bottom 252. The contacts 200 may be arranged in pairs with two signal contacts representing a differential pair, and the pairs being separated by ground contacts.

The contact tails 248 may be eye-of-the-needle type contacts that fit into vias in the circuit board 108. Other types of contacts may be used for through hole mounting or surface mounting to the circuit board 108. Different types of contacts may be used to terminate the contact module 128 to cables rather than to the circuit board 108, in alternative embodiments.

In the illustrated embodiment, at least some of the contacts 200 represent ground contacts 204 that are part of the lead frame and held within the contact module body 240. The ground contacts 204 may be connected to corresponding ground mating contacts of the receptacle assembly 102. Alternatively, rather than ground contacts 204 held by the contact module body 240, a separate shield (not shown) may be coupled to the contact module body 240, where the shield has the ground contacts 204 extending therefrom and interspersed between the mating portions 246 of the signal contacts 202 of the contact module 128.

The contact module body 240 includes a channel 260 extending therethrough. The channel 260 receives the organizer bar 142. The channel 260 extends between the sides 242, 244 along a channel axis 262. In an exemplary embodiment, the channel axis 262 is generally parallel to the mating interface 124 of the front housing 122. The channel 260 is generally cylindrical in shape, however other shapes are possible in alternative embodiments.

In an exemplary embodiment, the channel 260 is provided at the intersection between the rear 254 and the top 256. The channel 260 is open at the corner defined between the rear 254 and the top 256. The channel 260 is open-sided such that the organizer bar 142 may be snapped into the channel 260 through the open side of the channel 260.

The channel 260 is defined by an interior surface 264 of the contact module body 240. The channel 260 is stepped and includes at least one shoulder 266. In the illustrated embodiment, the channel 260 includes a plurality of flanges 268 that extend from the interior surface 264 into the channel 260. The flange 268 defines the shoulders 266 on both sides of the flange 268 that extend radially inward from a radially outermost portion of the interior surface 264. The flange 268 has a smaller diameter than the interior surface 264. In alternative embodiment, rather than a flange extending into the channel 260, a groove may be recessed from the interior surface 264 that has a diameter that is larger than the diameter of the interior surface 264. The groove may define the shoulders. Other types of features may be provided in the channel 260 that interact with the organizer bar 142 to position the contact module body 240 with respect to the organizer bar 142.

The contact module body 240 includes an outer perimeter defined by the front 250, the bottom 252, the rear 254 and the top 256. The channel 260 is recessed into the contact module body 240 interior of the outer perimeter of the contact module body 240. The organizer bar 142, when received in the channel 260, is contained entirely within the outer perimeter of the contact module body 240. An outer surface of the organizer bar 142 is positioned below the top 256 and forward of the rear 254. The channel 260 has an upper wall 270 and a rear wall 272. An opening 274 is defined between the upper wall 270 and the rear wall 272. The opening 274 provides access to the channel 260. The organizer bar 142 is loaded into the channel 260 through the opening 274. When the organizer bar 142 is in the channel 260, the upper wall 270 extends above a portion of the organizer bar 142. A portion of the rear wall 272 extends rearward of or behind a portion of the organizer bar 142. The upper wall 270 restricts removal of the organizer bar 142. The rear wall 272 restricts removal of the organizer bar 142. In an exemplary embodiment, the width of the opening 274 is less than a diameter of the organizer bar 142. When the organizer bar 142 is loaded into the channel 260, the upper wall 270 and/or the rear wall 272 may be at least partially deflected allowing the organizer bar 142 to pass through the opening 274 into the channel 260. The organizer bar 142 may be snapped into the channel 260 and held therein by the upper wall 270 and the rear wall 272.

In an exemplary embodiment, the organizer bar 142 is manufactured from a dielectric material, such as a plastic material. Optionally, the organizer bar 142 may be manufactured from a dielectric material having a similar dielectric constant as the dielectric material of the contact module body 240. Having the organizer bar 142 manufactured from dielectric material, the organizer bar 142 does not negatively impact the electrical characteristics of the header assembly 104.

The organizer bar 142 extends along a longitudinal axis 280. The organizer bar 142 has an outer surface 282 having a generally circular cross-section. The outer surface 282 of the organizer bar 142 is stepped and includes a plurality of shoulders 284. In the illustrated embodiment, the organizer bar 142 includes a plurality of grooves 286 therein that define the stepped outer surface 282. The grooves 286 define the shoulders 284, which extend radially inward from a radially outermost portion of the outer surface 282. When the organizer bar 142 is loaded into the channel 260, the flanges 268 are received in the grooves 286. The shoulders 266 engage the shoulders 284 to hold the position of the contact module body 240 with respect to the organizer bar 142. In an alternative embodiment, rather than grooves 286, the organizer bar 142 may include other features, such as flanges or posts extending outward from the outer surface 282 that are configured to extend into complementary features in the channel 260 to longitudinally position the contact module 128 with respect to the organizer bar 142.

When the organizer bar 142 is securely engaged in the channels 260, each of the contact modules 128 is held in place relative to the other contact modules 128. The organizer bar 142 holds the true position of the contact tails 248 for mounting to the circuit board 108.

The longitudinal positions of the contact modules 128 are controlled by the organizer bar 142. For example, the rears 254 of the contact module bodies 240 are properly spaced apart and held by the organizer bar 142, while the fronts 250 of the contact module bodies 240 are held by the front housing 122. The organizer bar 142 and the front housing 122 cooperate to orient the contact modules 128 along parallel planes. With the contact modules 128 properly positioned, the contact tails 248 of the contact modules 128 are properly aligned for loading into corresponding vias when the header assembly 104 is mounted to the circuit board 108.

Figure 3:
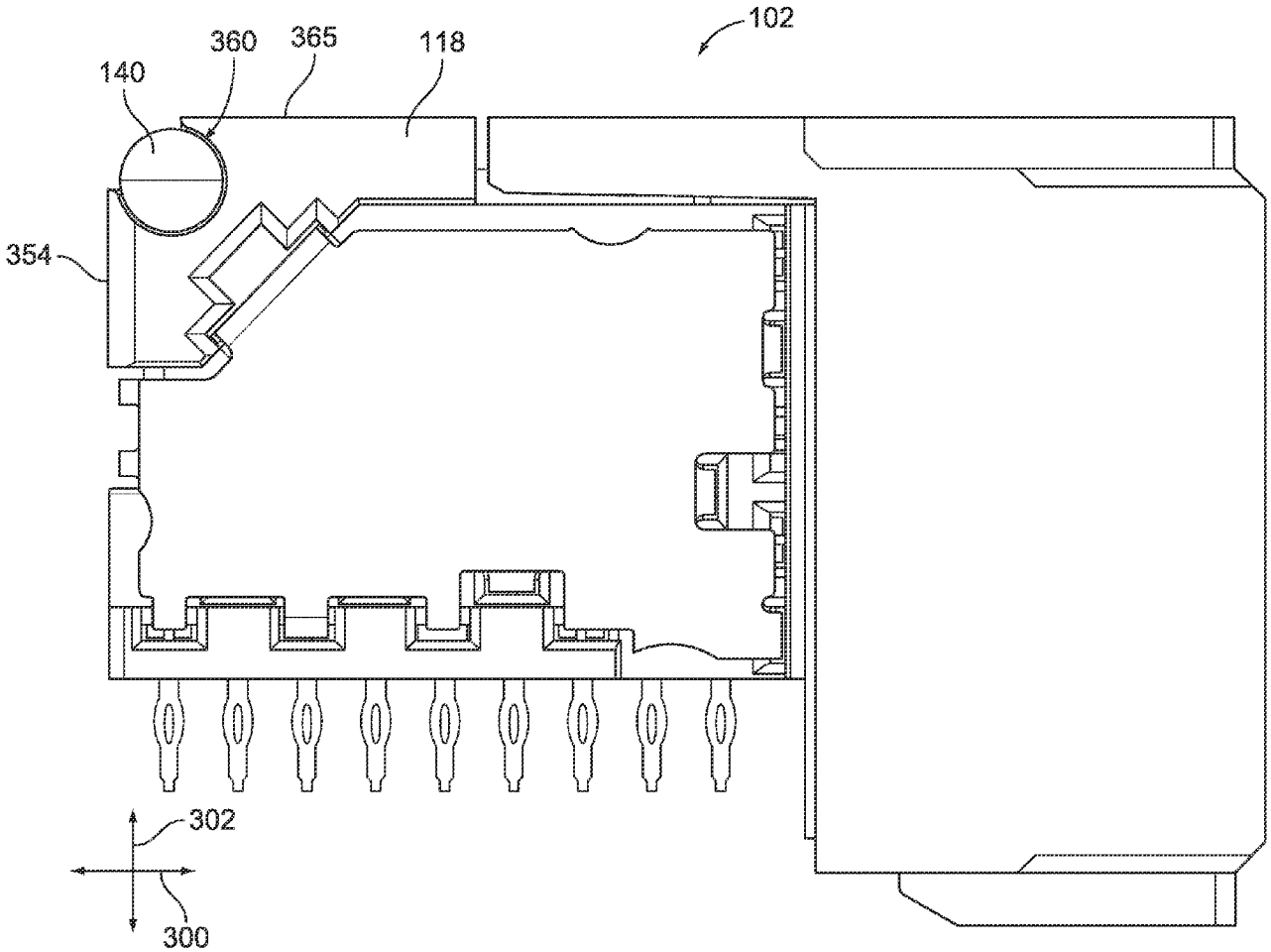
FIG. 3 is a side view of the receptacle assembly showing the organizer bar installed in the contact modules

FIG. 3 is a side view of the receptacle assembly 102, showing the organizer bar 140 installed in the contact modules 118. The organizer bar 140 is contained within the outer perimeter defined by the contact module 118. For example, the organizer bar 140 is positioned below a top 365 of the contact module 118 and is positioned forward of a rear 354 of the contact module 118. Having the organizer bar 140 extending through all of the contact modules 118 helps to hold relative movement of the contact modules 118 with respect to one another. For example, the organizer bar 140 holds the horizontal positions (e.g., front to back positions) along an axis 300 with respect to one another. The organizer bar 140 holds the vertical positions (e.g., top to bottom positions) of the contact modules 118 with respect to one another along an axis 302. Engagement between shoulders of the organizer bar 140 and shoulders defined within channels 360 of the contact modules 118 holds the side to side positions of the contact modules 118.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector assembly comprising:

a front housing having a mating interface;

contact modules held by the front housing and extending rearward from the front housing, each contact module having a plurality of conductors held by a dielectric contact module body, the conductors having mating portions extending from the contact module body and mounting portions extending from the contact module body, the contact modules having channels formed therein, the channels being defined by interior surfaces of the contact module bodies, the interior surfaces being stepped and including one or more flanges extending from the interior surfaces into the channels; and an organizer bar received in the channels of the contact modules, the organizer bar being manufactured from a dielectric material, the organizer bar including grooves extending circumferentially around the organizer bar, the flanges being received in corresponding grooves to hold the positions of the contact modules relative to one another.

2. The electrical connector assembly of claim 1, wherein the organizer bar engages all of the contact modules held by the front housing.

3. The electrical connector assembly of claim 1, wherein the channels are open sided, the organizer bar being snapped into the channels through the open sides thereof.

4. The electrical connector assembly of claim 1, wherein the organizer bar is circular in cross-section.

5. The electrical connector assembly of claim 1, wherein the organizer bar includes an outer surface, the outer surface of the organizer bar being stepped and including a plurality of shoulders, the channels including shoulders, the shoulders of the organizer bar engaging corresponding shoulders of the channels to maintain the relative positions of the contacts modules with respect to the organizer bar.

6. The electrical connector assembly of claim 1, wherein each contact module body includes a top, a bottom, a front, a rear and opposite sides, the mating portions extending from the front, the mounting portions extending from the bottom, the contact modules being held in the front housing such that the sides of adjacent contact modules face one another.

7. The electrical connector assembly of claim 6, wherein the channels are located at the intersection of the tops and rears of the contact module body.

8. The electrical connector assembly of claim 6, wherein the channels are located at the intersections of the tops and the rears of the contact module bodies, the organizer bar being received in the channels such that an outer surface of the organizer bar is positioned below the top and forward of the rear.

9. The electrical connector assembly of claim 6, wherein the contact module body includes an outer perimeter defined by the front, the top, the rear and the bottom, the organizer bar being contained entirely within the outer perimeter of the contact module body.

10. The electrical connector assembly of claim 6, wherein the channels are located at the intersection of the tops and the rears of the contact module bodies, each channel being bounded by an upper wall and a rear wall, an opening extending between the upper wall and the rear wall, the organizer bar being received in the channels through the openings between the upper walls and the rear walls, the openings being narrower than a diameter of the organizer bar such that the organizer bar is retained within the channels by the upper walls and the rear walls.

11. The electrical connector assembly of claim 1, wherein the organizer bar is manufactured from a material having a dielectric constant approximately equal to a dielectric constant of the contact module body.

12. The electrical connector assembly of claim 1, wherein the contact modules are overmolded lead frames, the channels being formed during the molding of the contact module body in an area of the contact module body devoid of the conductors.

13. An electrical connector assembly comprising:

a front housing having a mating interface;

contact modules held by the front housing and extending rearward from the front housing, each contact module having a plurality of conductors held by a dielectric contact module body, the contact module body having a top, a bottom, a front, a rear and opposite sides, the contact module body having a channel extending therethrough between the sides, the channel being located at the intersection of the top and the rear of the contact module body, each channel being bounded by an upper wall and a rear wall, an opening extending between the upper wall and the rear wall, the conductors having mating portions extending from the front of contact module body and mounting portions extending from the bottom of the contact module body; and an organizer bar received in the channels of the contact modules through the openings between the upper walls and the rear walls, the organizer bar being retained within the channels by the upper walls and the rear walls, the organizer bar holding the positions of the contact modules relative to one another.

14. The electrical connector assembly of claim 13, wherein the organizer bar includes an outer surface, the outer surface of the organizer bar being stepped and including a plurality of shoulders, the channels including shoulders, the shoulders of the organizer bar engaging corresponding shoulders of the channels to maintain the relative positions of the contacts modules with respect to the organizer bar.

15. The electrical connector assembly of claim 13, wherein the organizer bar is received in the channels such that an outer surface of the organizer bar is positioned below the top and forward of the rear.

16. The electrical connector assembly of claim 13, wherein the contact module body includes an outer perimeter defined by the front, the top, the rear and the bottom, the organizer bar being contained entirely within the outer perimeter of the contact module body.

17. The electrical connector assembly of claim 13, wherein the organizer bar is manufactured from a material having a dielectric constant approximately equal to a dielectric constant of the contact module body.

18. The electrical connector assembly of claim 13, wherein the channels are defined by interior surfaces of the contact module bodies, the interior surfaces being stepped and including one or more flanges extending outward from the interior surfaces into the channels, the organizer bar including grooves extending circumferentially around the organizer bar, the flanges being received in corresponding grooves.

19. An electrical connector assembly comprising:

a front housing having a mating interface;

contact modules held by the front housing and extending rearward from the front housing, each contact module having a plurality of conductors held by a dielectric contact module body, the conductors having mating portions extending from the contact module body and mounting portions extending from the contact module body, the contact modules having channels formed therein, the channels being defined by interior surfaces of the contact module bodies, the interior surfaces being stepped and including one or more grooves formed in and extending into the interior surfaces of the channels; and an organizer bar received in the channels of the contact modules, the organizer bar being manufactured from a dielectric material, the organizer bar including flanges extending circumferentially around the organizer bar, the flanges being received in corresponding grooves in the channels to hold the positions of the contact modules relative to one another.

20. The electrical connector assembly of claim 19, wherein the organizer bar engages all of the contact modules held by the front housing.

* * * * *